US008402676B2

(12) United States Patent
von Blücher

(10) Patent No.: US 8,402,676 B2
(45) Date of Patent: Mar. 26, 2013

(54) FIREPROOF FOOTWEAR WITH PROTECTIVE FUNCTION AGAINST TOXIC SUBSTANCES

(75) Inventor: Hasso von Blücher, Erkrath (DE)

(73) Assignee: Blucher GmbH, Erkrath (DE)

( * ) Notice: Subject to any disclaimer, the term of this patent is extended or adjusted under 35 U.S.C. 154(b) by 1009 days.

(21) Appl. No.: 11/912,600

(22) PCT Filed: Jan. 12, 2006

(86) PCT No.: PCT/EP2006/000215

§ 371 (c)(1),
(2), (4) Date: Apr. 16, 2008

(87) PCT Pub. No.: WO2006/117027

PCT Pub. Date: Nov. 9, 2006

(65) Prior Publication Data

US 2008/0282578 A1 Nov. 20, 2008

(30) Foreign Application Priority Data

Apr. 28, 2005 (DE) ..... 10 2005 020 204
Jun. 10, 2005 (DE) ..... 10 2005 026 837

(51) Int. Cl.
*A43B 23/02* (2006.01)
*A43B 3/00* (2006.01)

(52) U.S. Cl. ..... 36/45; 36/98; 36/113

(58) Field of Classification Search ..... 36/4, 45, 36/98, 113

See application file for complete search history.

(56) References Cited

U.S. PATENT DOCUMENTS 1,637,709 A 8/1927 Preble
3,870,554 A 3/1975 Minklei et al. ..... 117/138
4,217,386 A * 8/1980 Arons et al. ..... 428/198

(Continued)

FOREIGN PATENT DOCUMENTS

DE 1 095 711 12/1960
DE 691 31 464 T2 4/1991

(Continued)

OTHER PUBLICATIONS

McCullough et al. "A Comparison of standard methods for measuring water vapour permeability of fabrics", Measurements Science and Technology, 14, pp. 1402-1408, Aug. 2003.

(Continued)

*Primary Examiner* — Jila M Mohandesi
*Assistant Examiner* — Sharon M Prange
(74) *Attorney, Agent, or Firm* — Woodard Emhardt Moriarty McNett & Henry LLP

(57) ABSTRACT

The invention relates to fireproof and/or flame-resistant footwear (1), in particular boots for firefighters, with a protective function against harmful substances, such as toxic chemical substances, the footwear (1) having a multilayered structure (2), the structure (2) comprising an outer layer (3), facing away from the foot when the footwear is being worn, and an inner layer (4), in particular an inner lining, provided on the outer layer (3) and facing towards the foot when the footwear is being worn. An adsorption layer (5) with an adsorption material (6), in particular activated charcoal, adsorbing harmful substances, is additionally arranged between the outer layer (3) and the inner layer (4), and the outer layer (3) is additionally provided with a fireproof and/or flame-retardant coating or impregnation (12).

27 Claims, 1 Drawing Sheet

U.S. PATENT DOCUMENTS

| | | | | |
|---|---|---|---|---|
| 4,263,727 | A | 4/1981 | Bender et al. | |
| 4,513,047 | A | 4/1985 | Leach et al. | |
| 4,518,650 | A * | 5/1985 | Grot et al. | 442/199 |
| 4,843,739 | A * | 7/1989 | von Blucher et al. | 36/44 |
| 5,024,594 | A * | 6/1991 | Athayde et al. | 442/67 |
| 5,948,398 | A * | 9/1999 | Hanamoto et al. | 424/76.1 |
| 6,571,397 | B1 * | 6/2003 | Williams | 2/239 |
| 7,114,192 | B1 * | 10/2006 | Prouty | 2/161.6 |
| 7,572,322 | B2 * | 8/2009 | Bohringer et al. | 96/134 |
| 7,730,555 | B2 * | 6/2010 | Hexels | 2/239 |
| 2005/0106967 | A1 * | 5/2005 | Suzuki | 442/86 |

FOREIGN PATENT DOCUMENTS

| | | | |
|---|---|---|---|
| DE | 41 23 088 | A1 | 1/1993 |
| DE | 93 02 479 | U1 | 5/1993 |
| DE | 295 06 366 | U1 | 7/1995 |
| DE | 295 04 365 | U1 | 8/1995 |
| DE | 196 24 553 | A1 | 1/1998 |
| DE | 299 04 120 | U1 | 7/1999 |
| DE | 201 16 043 | U1 | 4/2002 |
| EP | 0 572 393 | B1 | 12/1993 |
| EP | 1 522 229 | A1 | 4/2005 |
| GB | 2 025 316 | A | 1/1980 |
| GB | 2 313 537 | A | 12/1997 |
| JP | 8196302 | A | 8/1996 |
| WO | 92/14372 | A | 9/1992 |

OTHER PUBLICATIONS

Rompp's Lexicon of Chemistry, 10th Edition, vol. 2, 1997, pp. 1352-1353, Georg Thieme Verlag, Stuttgart, New York.

* cited by examiner

FIREPROOF FOOTWEAR WITH PROTECTIVE FUNCTION AGAINST TOXIC SUBSTANCES

CROSS-REFERENCES TO RELATED APPLICATIONS

This application is a National Stage filing of International Application PCT/EP2006/000215, filed Jan. 12, 2006, claiming priority to German Application No. 10 2005 020 204.7, filed Apr. 28, 2005, and German Application No. 10 2005 026 837.4, filed Jun. 10, 2005, entitled "FIREPROOF FOOTWEAR WITH PROTECTIVE FUNCTION AGAINST TOXIC SUBSTANCES". The present application claims priority to PCT/EP2006/000215, to German Application No. 10 2005 020 204.7, and to German Application No. 10 2005 026 837.4, and all references are expressly incorporated by reference herein, in their entireties.

BACKGROUND OF THE INVENTION

This invention concerns a fire- or flame-resistant shoe, in particular, a boot for firefighters, with a protective function against contaminants, especially chemical toxins, as disclosed herein, in particular for fire control use in a chemically or biologically contaminated region or sphere of application.

People who are active in the field of firefighting, such as firefighters, are often exposed to adverse ambient or environmental conditions during deployment. For instance, very high temperatures frequently prevail at the deployment site and toxic substances frequently form, in particular due to the effect of fire, and those being deployed must be protected from them. This is particularly true in deployments in large scale fires, especially in chemical plants, in which a large number of sometimes highly toxic substances can be released. People such as firefighters who come into contact with toxic substances like chemical toxins must wear suitable chemical equipment that has good flame or fire resistance on the one hand and a protective function against toxic substances on the other.

Here, care should be taken in particular that the feet are also sufficiently protected against the effect of the fire and toxic substances like chemical toxins. In particular, such a protective shoe must be suitable for use in fighting fires and decontamination. According to the prior art, in firefighting, boots are worn for this purpose that generally have the crucial disadvantage that frequently neither measures for significant improvement of the flame-inhibiting or fire-resistant properties and thus protection against high temperatures, nor measures nor means are provided with which the passage of chemical or biological toxins through the boot material is efficiently and effectively stopped. Thus, effective protection against chemical or biological toxins is not always guaranteed with the shoe in accordance with the prior art, and the flame resistance is not always satisfactory, so that such footwear cannot always guarantee optimum protection in use.

For instance, DE 196 24 553 A1 concerns a boot with a foot section and a boot leg, which has a special lacing/lacing connector, with which a undesirable loosening of the lacing/lacing connector is said to be avoided when worn and, in addition, when worn, the boot is supposed to lie tightly against the foot even when flexed. Special measures to improve the fire- or flame-inhibiting properties or targeted measures to improve the protective function against contaminants like chemical toxins are not envisioned in said document.

DE 295 04 365 U1 concerns a boot that has a sloping instep section that takes a foot section in the front into a boot leg where the instep section is covered by an unbreakable and rigid cover. This is said to improve the protection against accidents, since the cover is supposed to be capable of absorbing higher forces. Special measures to improve the fire or flame resistance and protect against contaminants are also not mentioned in said document.

In addition, DE 41 23 088 A1 concerns a method for producing heat-resistant boots, in which a sole is assembled to the leg of the boot by a special connection using pressure molds. This document primarily focuses on a heat-stable embodiment of the adhesive connection between the sole and the boot.

DE 201 16 043 U1 concerns a protective boot for firefighters made of a conventional boot material, which is supposed to be more easily put on and taken off because of the use of a stretchable fold in the instep region. Said document envisions a textile material that is optionally coated with a polyurethane, silicone or plastic as the material for the stretchable fold. Providing the rest of the shoe region with protection against contaminants is not envisioned in this document.

In addition, DE 295 06 366 U1 concerns a closed protective boot, whose vamp and quarter are each made in a single piece, due to which the boot leg is supposed to be watertight up to the height of the ankle due to the presence of fewer stitches and, moreover, the protective boot is supposed to be able to be slipped on quickly. In this document, too, there are no measures to make the upper material of the boot fire- or flame-inhibiting nor to provide the protective boot with improved protection against contaminants.

Finally, DE 691 31 464 T2 concerns a protective shoe arrangement that is said to be suitable for firefighters as well, in which a protective insert forms an integrated capsule to protect the sole, heel and toes of the foot. Thus, this document primarily focuses on a physical protective function with respect to the foot of the wearer, since the wearer is supposed to be protected against the effect of high forces.

Thus, all in all, there are no boots known from the prior art, in particular, no boots for firefighters, that provide a high protective function against toxic substances, especially chemical toxins, while at the same time being provided with fire- or flame resistance. Accordingly, it is not always guaranteed in the prior art that the footwear described there will satisfy the high demands made in firefighting and decontamination.

This invention therefore is based on the task of making available a fire- or flame-resistant shoe, in particular a boot for firefighters, that is particularly suitable for use in firefighting or decontamination and that at least in part avoids or at least diminishes the disadvantages of the prior art that were described above.

To solve the described task, this invention proposes a fire- or flame-resistant shoe, in particular a boot for firefighters, in accordance with Claim 1. Other advantageous embodiments of the fire- or flame-resistant shoe in accordance with the invention are objects of the dependent claims.

One aspect of this invention is to be seen in the fact that the fire- or flame-resistant shoe is additionally provided with a fire- or flame-inhibiting coating or impregnation. This ensures that the shoe is also resistant at high temperatures and under the effect of flames or fire, as often arise within the scope of fighting fires, and it effectively protects the wearer of the shoe against the effect of high heat or burns. The fire- or flame-resistant properties of the shoe in accordance with the invention can be achieved, for example, by the fact that a special fire- or flame-inhibiting coating or impregnation, for example one based on phosphoric acid compounds, metal salts or fluorinated polymers, is used, in particular in combination with a poorly flammable material such as a leather and/or a poorly flammable textile material. An especially effective fire- or flame resistance is obtained through this, so that the shoe in accordance with the invention is excellently suitable for use in firefighting.

Another aspect of the invention that is realized in combination with said measures lies in a fire- or flame-resistant shoe, in particular a boot for firefighters, with a multilayer structure, which includes an outer layer that is turned away from the foot when the shoe is worn and an inner layer integrated with the outer layer and turned toward the foot when the shoe is worn, in particular, a shoe inner liner, that is also provided with a protective function against contaminants like chemical toxins (i.e., in addition to the fire- or flame-resistance) by providing or arranging an additional adsorption layer based on an adsorption material that adsorbs toxic substances, in particular, activated carbon, between the outer layer and the inner layer. In this way, contaminants that may have penetrated through the outer layer of the shoe, in particular, chemical toxins, cannot come into contact with the foot, since they can be absorbed or adsorbed by the adsorption material, in particular, the activated carbon, of the adsorption layer and in this way, made harmless.

BRIEF SUMMARY

The invention relates to fireproof and/or flame-resistant footwear (1), in particular boots for firefighters, with a protective function against harmful substances, such as toxic chemical substances, the footwear (1) having a multilayered structure (2), the structure (2) comprising an outer layer (3), facing away from the foot when the footwear is being worn, and an inner layer (4), in particular an inner lining, provided on the outer layer (3) and facing towards the foot when the footwear is being worn. An adsorption layer (5) with an adsorption material (6), in particular activated charcoal, adsorbing harmful substances, is additionally arranged between the outer layer (3) and the inner layer (4), and the outer layer (3) is additionally provided with a fireproof and/or flame-retardant coating or impregnation (12).

BRIEF DESCRIPTION OF THE SEVERAL VIEWS OF THE DRAWINGS

Other advantages, characteristics, properties and aspects of this invention emerge from the following description of a preferred embodiment by means of the drawings. Here:

FIG. 2 shows a schematic cross section through the layer structure of a shoe in accordance with the invention, in particular, a boot for firefighters, in accordance with a preferred embodiment of the invention.

DETAILED DESCRIPTION

Figure 1:
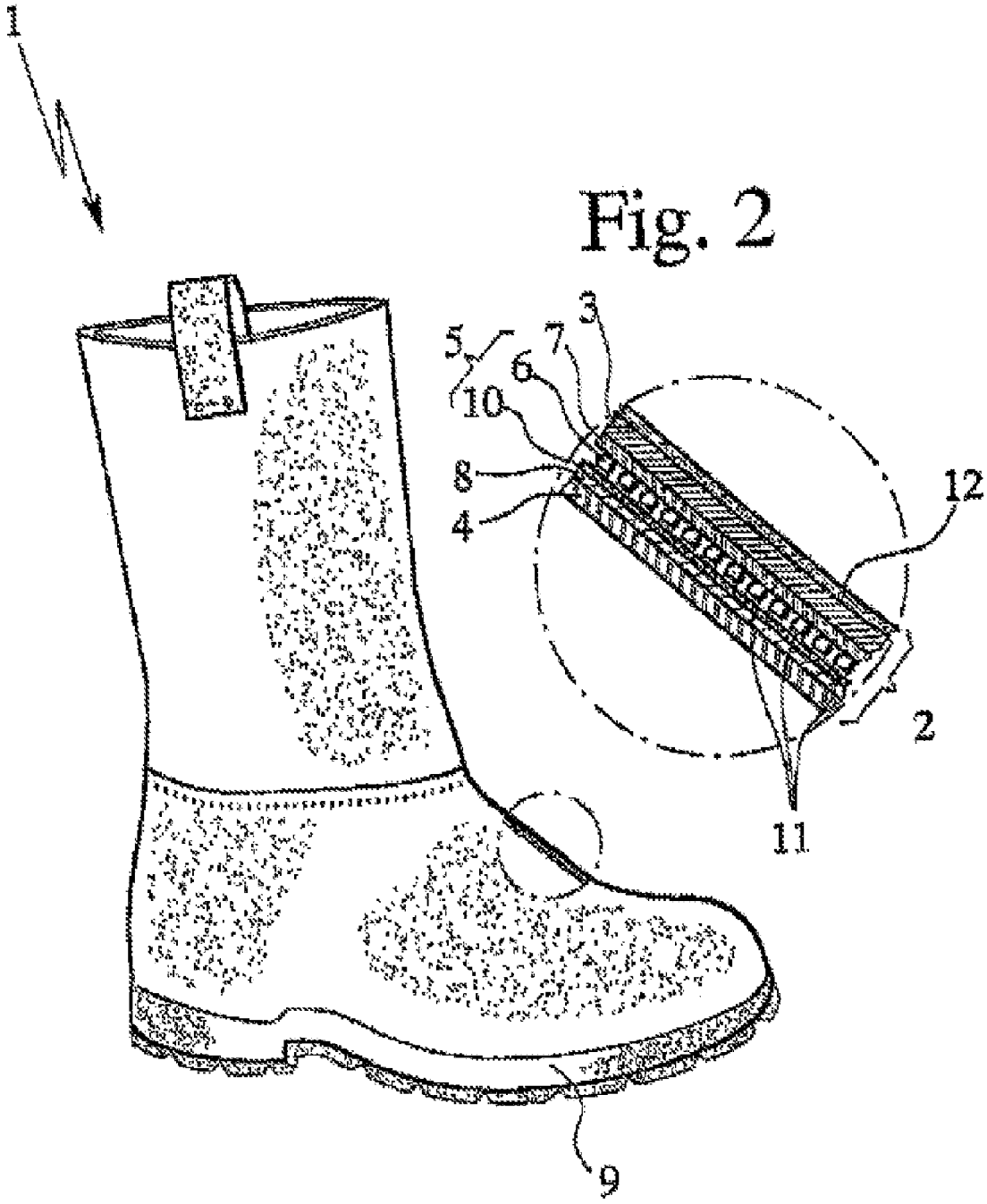
FIG. 1 shows a schematic representation of a fire- or flame-resistant shoe, in particular, a boot for firefighters, in accordance with a preferred embodiment of the invention.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

FIG. 1 shows a fire- or flame-resistant shoe 1, in particular, a boot for a firefighter, with a protective function against contaminants like chemical toxins or biological contaminants. As can be seen from FIGS. 1 and 2, the fire- or flame-resistant shoe in accordance with the invention has a multilayer structure 2 with an outside (i.e., turned away from the foot when worn) outer layer 3 and an inside (i.e., turned toward the foot when worn) inner layer 4 that is integrated with the outer layer 3, in particular, a shoe inner liner.

Further, FIG. 2 shows that an adsorption layer 5 is also arranged between the outer side 3 and the inner layer 4. Adsorption layer 5 consists of an adsorption material 6 that adsorbs toxins, where the adsorption material is preferably activated carbon, as discussed in more detail below. Because the shoe in accordance with the invention is specially provided with adsorption layer 5, efficient protection against contaminants like chemical toxins and biological contaminants is guaranteed while at the same time assuring high wearing comfort.

As can further be taken from FIG. 2, it is additionally provided that at least the outer layer 3 of the multilayer structure 2 of fire- or flame-resistant shoe 1 in accordance with the invention is provided with a fire- or flame-inhibiting coating or impregnation 12. This ensures that the shoe 1 in accordance with the invention can also be used under the effects of flame and fire, in particular, in fighting fires, since it has fire- or flame-resistant properties. Thus, the fire- or flame-resistant shoe 1 in accordance with the invention is particularly suitable for firefighters, since high ambient temperatures frequently exist, in particular, in firefighting situations and the shoe often comes directly into contact with fire, flames, embers, or the like.

Regarding the fire- or flame-inhibiting coating or impregnation 12 of the fire- or flame-resistant shoe 1 in accordance with the invention, substances or chemical compounds that are substantially known to one skilled in the art in this regard, inorganic or organic in nature, that makes the outer layer 3 of the shoe 1 flame-proof or flame-inhibiting, can be used. These include, for example, substances that prevent combustion of outer layer 3 or make its ignition and/or combustion difficult. For example, in accordance with the invention, substances that smother fires, promote charring or that form barrier layers or insulating layers can be used for the flame-inhibiting coating or impregnation 12 of outer layer 3.

In this connection, fire-smothering or char-promoting flame retardants—without wishing to be tied to any particular theory—act, insofar as they form an incombustible or thermal insulating layer, to combat fire and heat, under the effect of heat, or to enhance the formation of said layer act to control the thermal degradation of carbon compounds so that the charring of the layer that is to be protected—in this case the outer layer 3—is promoted and the release of combustible gases is diminished. Among these substances is, for example ammonium phosphate, which under the effect of heat not only gives up ammonia, but also has a dehydrating effect, since it releases phosphoric acid, which has a charring activity.

Furthermore, barrier layer-forming agents or sealing agents that—without wishing to be tied to a particular theory—under the effect of heat form poorly flammable thin barrier layers that block the access of oxygen to a layer impregnated with them can be used in accordance with the invention. Such barrier layer-forming agents include, for example, ammonium polyphosphate and expanded graphite.

Furthermore, it is also possible to use the so-called insulation layer-forming agents, which—without wishing to be tied to any particular theory—combine the properties of the char-promoting and barrier layer-forming flame retardants, where it is also possible to use foaming substances that foam up when heated and char, for example, starting from 250-300° C., solidifying in doing so and thus form a fine-pored cushion with good insulating properties. Such substances include, for example, organic phosphate compounds.

In accordance with the invention it is equally possible to use combinations of said flame retardants. Furthermore, it is also possible to use substances whose thermal dehydration consumes enough energy to make them suitable as flame retardants, for example, aluminum hydroxides.

Radical traps that interrupt the chain reaction of combustion can also be used in accordance with the invention as fire- or flame-inhibiting coating or impregnation 12. These can be, for example, antimony compounds like antimony trioxide, especially in combination with a halogen donor. In accordance with the invention it is also possible to carry out a textile chemical coating or impregnation of the outer layer 3 with phosphorus compounds, where—without wishing to be tied to a specific theory—the outer layer 3 is provided with a thin oxygen-barrier coating that breaks the carbon compound, for example, cellulose in the case of textiles, into carbon and water catalytically during combustion.

For other similar details on flame retardants, one can refer to *Römpp's Chemical Lexicon,* 10$^{th}$ Edition, Volume 2, 1997, Georg Thieme Publishers, keyword: "flame retardant", pp. 1352-1353, the entire content of which, including the references cited therein, is hereby included by reference.

In accordance with the invention, the fire- or flame-inhibiting coating or impregnation 12 is preferably formed on the basis of (i) phosphoric acid compounds, especially phosphoric acid ester, (ii) metal salts, especially antimony or aluminum salts, or (iii) fluorinated polymers, and mixtures of two or more of said compounds.

The fire- or flame-inhibiting coating or impregnation 12 can be applied in way that is substantially known to one skilled in the art, for example, in the form of a lotion, suspension or the like, by immersion, atomization and/or by means of a pressure/vacuum impregnation, etc. Application by means of a doctor knife or roller spreader device, by spray coating, by calendering and/or by screen print transfer coating is equally possible. It is equivalent within the scope of this invention if the fire- or flame-inhibiting coating or impregnation 12 takes place by means of chemical incorporation or grafting of flame-inhibiting compounds, for example, in the form of monomers, into or onto the molecular structure of the outer layer 3. For example, grafting by means of vinyl phosphonic acid is possible. Such methods are known to one skilled in the art, and one skilled in the art is naturally capable of choosing the type and manner of application of the coating or impregnation to the outer layer 3 of the shoe 1 in accordance with the invention in the light of this invention and carrying this out. Equally, it is possible in accordance with the invention to provide the other layers of the layer structure 2, especially the inner layer 4 or other layers, with a fire- and/or [flame-]inhibiting coating or impregnation.

Regarding the outer layer 3 of the fire- or flame-resistant shoe 1 that is shown in FIG. 2, it can preferably be made of a poorly flammable material, in particular a leather or poorly flammable textile material, or can consist of such material. Among the poorly flammable textile materials are, for example, aramide fibers, polyamide fibers, fibers with higher halogen content, which can be designed to be self-extinguishing, for example. Leather is preferably used as the material for the outer layer 3.

In addition, the outer layer 3 of the shoe 1 in accordance with the invention can be made out of a breathable, in particular, water vapor-permeable material such as polyamides (in particular, nylon, for example, Codura® from the DuPont company). Examples are dense and weather-resistant polyamide or nylon sheet fabrics, especially wovens or knits made therefrom. If a breathable material is used as outer layer 3, an additional oil-proofing and/or waterproofing of the material of the outer layer 3 is recommended, in particular, by means of a special impregnation, in order to prevent or impede the penetration of contaminants. Alternatively, the outer layer 3 can, however, also consist of a plastic material, for example, butyl rubber, rubbers (for example, chloroprene rubbers like neoprene or fluorine rubbers) or even fluoroelastomers (for example, Viton® from DuPont Dow Elastomers LLC); in this case an oil-proofing or waterproofing can be omitted, since these materials are already oleophobic and hydrophobic as such.

The thickness of the material of the outer layer 3 can vary in a wide range. However, it is preferable in accordance with the invention to specify an outer layer 3 thickness in the range of 0.5-4 mm, preferably 1-3 mm, preferably 1-2.5 mm.

The shoe 1 in accordance with the invention preferably has a poorly flammable sole 9, where it is preferable in accordance with the invention for the sole 9 to be at least essentially water- or air-impermeable. So that contaminants like chemical toxins or biological contaminants cannot penetrate into the shoe 1 via the sole 9, the sole 9 is generally made of a material that is at least essentially impermeable to such contaminants or at least delays their passage. In general, the sole 9 can consist of a plastic or rubber material that is known for these purposes to one skilled in the art. One such material that is suitable for use in the sole 9 is, for example, nitrile rubber. To ensure efficient protective function, the shoe sole 9 could be tightly bonded to the shoe upper 2, in particular in the region where the sole 9 makes the transition to shoe upper 2; this takes place in a substantially known way, for example, by stitching, gluing, welding, etc. In this way, the region of the sole of the foot is, like the rest of the foot, sufficiently protected against contaminants and the effects of flame and fire.

Regarding the material of the inner layer 4, in particular, the inner liner of the shoe 1, any textile materials can be used here, preferably air-permeable textile materials, for example, textile sheet materials. Non-limiting examples are wovens, warp and weft knit fabrics, laid fabrics, textile composites or nonwovens. Preferably a woven or a knit material or a nonwoven material is used as material for the inner layer 4. As discussed above, the inner layer 4 can optionally also be provided with a fire- or flame-inhibiting coating or impregnation.

As FIG. 2 shows, the shoe 1 in accordance with the invention has, in addition to adsorption layer 5, at least one membrane 7, which can be arranged either between the outer layer 3 and the adsorption layer 5 or between the inner layer 4 and the adsorption layer 5. Preferably, the membrane 7 is arranged between the outer layer 3 and the adsorption layer 5, i.e., on the side of the adsorption layer 5 that is turned away from the foot when the shoe is worn. The membrane 7 is preferably water-impermeable or air-impermeable and is preferably at least essentially impermeable to toxins such as chemical or biological toxins, or at least delays their passage. Because of these particular properties and because of the preferred arrangement of membrane 7 between the outer layer 3 and the adsorption layer 5, it is ensured in accordance with the invention that contaminants that may have penetrated through the outer layer 3 of shoe 1 will already be held back by membrane 7, so that consequently they do not reach the adsorption layer 5 at all or at most reach it in only very small amounts; in this way for one thing, the capacity of the adsorption layer is almost never exhausted and, for another, the presence of membrane 7 provides additional protection for the wearer of shoe 1, resulting in a shoe with this, so to say, doubled protective function against contaminants (specifically, on one hand, by the barrier action of membrane 7 and, on the other hand, by the adsorption action of adsorption layer 5). Moreover, because of the presence of membrane 7, the shoe 1 can be decontaminated and regenerated; toxins that may have penetrated through the outer layer 3 can be removed or flushed out of membrane 7 by appropriate treatment methods, for example, with suitable decontamination solutions, which are very well known for the purpose to one skilled in the art.

To further improve the wearing comfort of the shoe 1 in accordance with the invention, it can be provided in accordance with the invention that the membrane 7 be breathable, in particular, water vapor-permeable. In particular, the membrane 7 should have a water vapor permeability, at 25° C. and a thickness of 50 μm, of at least 12.5 $L/m^2/24$ h, in particular, at least 17.5 $L/m^2/24$ h, preferably at least 20 $L/m^2/24$ h or even higher (measured by the "inverted cup method" in accordance with ASTM E 96 at 25° C.). (For further details on measuring the water vapor permeability (water vapor transmission, WVT) one can refer to McCullough et al. "A comparison of standard methods for measuring water vapour permeability of fabrics" in *Meas. Sci. Technol.* (*Measurements Science and Technology*) 14, 1402-1408, August 2003). Particularly high wearing comfort is ensured through this.

For these purposes, the membrane should have a resistance to water vapor transmission $R_{et}$ under steady-state conditions of a maximum of 25 ($m^2$·pascal)/watt, especially a maximum of 20 ($m^2$·pascal)/watt, preferably a maximum of 13 ($m^2$·pascal)/watt, for a thickness of 50 μm, measured at 35° C. in accordance with DIN 31 093:1993, February 1994 ("Textiles—physiological effects, measurements of resistance to transmission of heat and water vapor under steady-state conditions (sweating guarded-hot plate test)") or by the equivalent International Standard ISO 11 092.

The optionally provided membrane 7 can be a continuous, in particular closed, and at most microporous membrane 7. The thickness of membrane 7 can vary in wide ranges; in general, it is in the range of 1-500 μm, in particular 1-250 μm, preferably 1-100 μm, preferably 1-50 μm, especially preferably 2.5-30 μm, really especially preferably 5-25 μm.

The membrane 7 that is optionally provided should only at the most be swellable or have the capacity to absorb water; in particular, the swellability and/or the water absorption capacity of membrane 7 should amount to a maximum of 35%, in particular, a maximum of 25%, with respect to the actual weight of membrane 7. Membranes 7 that are suitable in accordance with the invention are at least essentially impermeable to liquids, in particular water, and/or to aerosols, or at least delay their passage. To achieve an at most negligible swellability, the membrane 7 should have no or essentially no highly hydrophobic groups, in particular, no hydroxyl groups. For purposes of negligible swelling, the membrane 7 can, however, have weakly hydrophilic groups, in particular polyether groups.

The membrane 7 that is optionally present can consist of a plastic or polymer material or contain such material. One such plastic or one such polymer can be, for example, a polyurethane, polyether amide, polyester amide, polyether ester, polytetrafluoroethylene or a cellulose-based polymer. Derivatives of said compounds can equally be used. Preferably, the plastic or the polymer is a polyether ester or a polytetrafluoroethylene.

According to a particular embodiment, the optionally present membrane 7 can be designed to be a multilayer laminate or a multilayer composite. This laminate or composite can consist of two, preferably at least three, layers or plies that are bonded together. This particular design of membrane 7 makes it possible to combine barrier layer materials with different properties, in particular, different water vapor permeabilities and barrier effects against contaminants and, in this way, to achieve an optimization of the properties of membrane 7.

To improve the stability of optional membrane 7, it is advantageous to arrange membrane 7 on a flat support layer, not shown in the figures (i.e., on a preferably air-permeable textile material, for example, a textile sheet material, for example, a woven, warp or weft knit, laid fabric or textile composite). For these purposes, the membrane 7 can be laminated through the carrier layer, in particular, by means of a preferably spot-wise applied adhesive. The sheet support layer for the membrane 7 acts more or less like a support layer and increases the mechanical stability and tear resistance of membrane 7, which is particularly important when membrane 7 serves at the same time as a support 10 for the adsorption material 6.

To improve the wearing comfort on the one hand and to achieve good resistance to wear and tear on the other, it is advantageous if membrane 7 has a certain elasticity. In particular, it is advantageous if the membrane 7 can be drawn or stretched at least 10%, especially at least 20%, preferably at least 30%, at least in one direction. Also, the layer structure 2 as a whole should also have a certain elasticity in addition to good flexibility, for said purposes; compared to membrane 7, the elasticity of the shoe upper 2 as a whole is lower, and in general, the shoe upper 2 is overall drawable or stretchable by at least 5%, preferably at least 10%, at least in one direction.

The absorption layer 5 is generally formed to be discontinuous, i.e., the absorption layer 5 in general consists of discrete adsorption particles 6 that adsorb chemical toxins (for example, those based on activated carbon), which can be secured on a support 10 by means of an adhesive 11, as shown in FIG. 2. The adsorption material 6 of adsorption layer 5 is, in particular, an adsorption material that contains activated carbon or consists thereof, for example, a material based on activated carbon, in particular in the form of activated carbon particles and/or activated carbon fibers.

The good wearing properties of the shoe 1 in accordance with the invention are improved still further when an adsorption layer 5 based on activated carbon is used, through the buffer effect of the activated carbon, since activated carbon serves as a store or buffer for moisture or water (for example, for perspiration from the foot). When, for example, activated carbon is used as an adsorption material for the adsorption layer, layers of up to about 250 $g/m^2$ or more are normal, so that, for example, for a perspiration rate of about 40 $g/m^2$, moisture can be stored, and if the outer layer 3 is breathable, it can then be released back into the atmosphere.

In general, the adsorption layer 5 is formed as an adsorption sheet filter. For this purpose, the adsorption layer 5 contains an adsorption material 6 that adsorbs chemical toxins, preferably one based on activated carbon, for example, in the form of activated carbon particles and/or activated carbon fibers, where the adsorption material 6 is generally affixed to a support 10, in particular, a textile support. The adsorption material 6 of adsorption layer 5 is preferably arranged on the side of support 10 that is turned away from the foot when the shoe is worn. Basically speaking, however, it is also possible to provide support 10 with adsorption material 6 on both sides. However, it is generally sufficient to provide support 10 with adsorption material 6 on just one side. The securing of the adsorption material 6 on support 10 takes place in a substantially ordinary way, for example, by continuous or preferably discontinuous application of an adhesive 11 to support 10, where the adsorption material 6 then becomes affixed on the adhesive 11. To improve wearing comfort, especially to avoid stiffness of support 10, a discontinuous, in particular spot-wise, application of the adhesive is preferred, i.e., the support 10 is advantageously imprinted discontinuously or spot-wise in a preferably regular pattern or grid with the adsorption material 6. The actual adsorption material 6 can in this case be laminated with a preferably air-permeable textile material, in particular, a textile sheet material, as a cover layer in order to reduce mechanical stress on the adsorption material (for example, with a sheet material having a lower areal weight of 5-75 g/m$^2$, especially 10-50 g/m$^2$, preferably 15-30 g/m$^2$); however, the provision of such a cover or lamination layer is purely optional.

For efficient adsorption performance it is preferable if at least 50%, especially at least 60%, preferably at least 70%, especially preferably at least 75%, really especially preferably at least 80%, of the support 10 is provided with adsorption material 6. Here, care should be taken that the amount and kind, especially the viscosity, of the adhesive 11 is laid out so that the adsorption material 6 of adsorption layer 5 is freely accessible to the chemical toxins that are to be adsorbed, in the amount of at least 50%, especially at least 60%, preferably at least 70%, i.e., the adsorption material is not completely pressed or immersed into adhesive 11.

As described above, the adsorption material 6 of adsorption layer 5 can consist, for example, of discrete activated carbon particles, for example, in granular form ("granular carbon"), especially preferably in spherical form ("spherical carbon").

Granular carbon, especially spherical carbon, has the decisive advantage that it is extremely abrasion resistant and very hard, which is very important with regard to the wear properties. Preferably, the breaking pressure for an individual activated carbon particle, especially an activated carbon granule or sphere, is generally at least about 5 N, especially at least about 10 N and can be as much as 20 N. In the case of granule carbon or ball carbon, the average diameter of the activated carbon particles is less than 1.0 mm, preferably less than 0.8 mm, preferably less than 0.6 mm, but in general, is at least 0.1 mm. With this embodiment, the activated carbon particles are generally applied in an amount of 5-500 g/m$^2$, especially 10-400 g/m$^2$, preferably 20-300 g/m$^2$, preferably 25-250 g/m$^2$, to the support material 10.

According to an alternative embodiment, the adsorption layer 5 can consist of activated carbon fibers, especially in the form of activated carbon sheet goods, as adsorption material 6. Such activated carbon sheet goods can, for example, have an areal weight of 20-200 g/m$^2$, especially 50-150 g/m$^2$. These activated carbon sheet goods can, for example, be activated carbon wovens, knits, laid materials or composite substances, for example, those based on carbonized and activated cellulose and/or carbonized and activated acrylonitrile.

Equally, it is also possible to combine activated carbon particles and activated carbon fibers together as the adsorption material 6 of adsorption layer 5. In this connection, activated carbon particles have the advantage of higher adsorption capacity, while activated carbon fibers have better adsorption kinetics.

The activated carbon that is used in accordance with the invention preferably has an internal surface area (BET) of at least 800 g/m$^2$ [sic; m$^2$/g], especially at least 900 g/m$^2$, preferably at least 1000 g/m$^2$, preferably in the range from 800-1500 g/m$^2$.

To improve the adsorption efficiency or the adsorption performance, the adsorption material 6 of adsorption layer 5, especially the activated carbon particles or fibers, can additionally be impregnated with a catalyst. Catalysts that are suitable in accordance with the invention are, for example, enzymes and/or metal ions, preferably copper, silver, cadmium, platinum, palladium, zinc and/or mercury ions. The amount of catalyst can vary within wide ranges; in general it is 0.05-12 wt %, preferably 1-10 wt %, especially preferably 2-8 wt %, with respect to the weight of the adsorption layer 5.

Within the scope of this invention it can be provided that between the inner layer 4 and the adsorption layer 5 or between the inner layer 4 and the membrane 7, in each case according to the sequence of layers 4, 5 and 7 in the layer structure 2, that a spacer layer 8 is additionally arranged, which can be, for example, in the form of a nonwoven, a thin foam layer or a textile sheet material (for example, a knit). Advantageously, the spacer layer 8 is arranged directly on the inner layer 4 (i.e., on the side of inner layer 4 that is turned away from the foot when the shoe is worn). The additional spacer layer 8 has the advantage that it reduces the mechanical stress on adsorption layer 5 or membrane 7, since there is, between the inner layer 4 on the one hand and the adsorption layer 5 or membrane 7 on the other, an additional layer that can trap or isolate mechanical stresses. For another thing, such an arrangement prevents contaminants that originate from the wearer, for example, perspiration, from needlessly loading the adsorption material 6 of adsorption layer 5. The efficiency of the adsorption layer 5 is also increased in this way. For another thing, the additional spacer layer 8 improves the wearing comfort of the shoe 1 in accordance with the invention, especially the sensation of softness.

In general, the individual layers 3, 4, 5, 7 and 8 of the layer structure 2 are each bonded together; this takes place by methods that are substantially known for this purpose (for example, by gluing, welding, stitching, stapling, etc.). Advantageously, the individual layers 3, 4, 5, 7 and 8 of the layer structure are bonded or secured together seamlessly, preferably without damaging the individual layers 3, 4, 5, 7 and 8 (for example, by gluing, welding, etc.). If the layers 3, 4, 5, 7 and 8 are at least in some cases stitched together or connected similarly, it is recommended that the stitch points be sealed (for example with a seam sealing strip). In particular, the individual layers 3, 4, 5, 7 and 8 of the layer structure form a coherent composite.

The shoe in accordance with the invention has the decisive advantage that, on the one hand, fire- or flame-resistant properties due to the fire- or flame-inhibiting coating or impregnation, and, on the other hand, higher protection against contaminants like chemical toxins, due to the adsorption layer, are combined in a single article of clothing. Because of these properties, the shoe in accordance with the invention is especially suitable for use in fighting fires and decontamination, and this is the case in particular with integration into an overall protective concept, for example, in combination with a fire- or flame-resistant protective suit.

Because of the high efficiency of the protective function of the adsorption layer, which as desired can optionally be increased even further through the use of a membrane, it is possible also to use outer materials for the shoe that breathe, such as leather, so that the wearing comfort can be improved even further in this way without the wearer of the shoe being exposed to increased danger due to the use of a breathable outer material.

Due to the extraordinarily high protective function of the shoe in accordance with the invention, it can also be used in contaminated areas, for example, as part of a decontamination operation, since the shoe in accordance with the invention also has efficient protection against chemical contaminants.

Because of the high fire- or flame resistance of the shoe in accordance with the invention, it is especially suitable for use in fighting a fire at high temperatures. In this regard, the wearer of the shoe, because of the good flame resistance of the shoe in accordance with the invention, is protected on the one hand against the effect of fire; and on the other hand, the fire- or flame-inhibiting coating or impregnation prevents destruction or combustion of the shoe as such, so that even under such adverse conditions, effective protection for the wearer of the shoe continues to exist.

Because of the good flexibility of the individual layers of the shoe or shoe structure in accordance with the invention, not only is good wearing comfort achieved overall, but the shoe in accordance with the invention has good resistance to wear.

The shoe in accordance with the invention can be produced in a substantially known way. This is very well known by a person skilled in the art who is involved in the manufacture of shoes, so that greater detail is not required in this regard.

Other embodiments, modifications and variations of this invention are easily recognizable and realizable for one skilled in the art upon reading the description, without going beyond the scope of this invention.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A flame-resistant shoe having a protective function against contaminants, including chemical toxins, comprising:

a shoe body having a multilayer construction including an outer layer turned away from the foot when the shoe is worn and an inner layer turned toward the foot when the shoe is worn and integrated with the outer layer;

an adsorption layer with an adsorption material including activated carbon that adsorbs contaminants is arranged between said outer layer and said inner layer, wherein said activated carbon is in the form of discrete activated carbon particles in granular or spherical form;

wherein said outer layer includes the addition of a flame-inhibiting material which is selected from the group consisting of a coating and an impregnation, said flame-inhibiting material being made on the basis of (i) phosphoric acid compounds; (ii) metal salts; (iii) fluorinated polymers, and mixtures of two or more of the same compounds; and a spacer layer is additionally arranged between said inner layer and said adsorption layer, wherein said spacer layer includes a material selected from the group consisting of a non-woven material, a foam material, and a textile sheet material.

2. The flame-resistant shoe of claim 1 wherein the activated carbon has an internal surface area (BET) in the range of 800 to 1500 $m^2/g$.

3. The flame-resistant shoe of claim 1 which further includes at least one water-impermeable and air-impermeable membrane.

4. A flame-resistant shoe having a protective function against contaminants, including chemical toxins, comprising:

a shoe body having a multilayer construction including an outer layer turned away from the foot when the shoe is worn and an inner layer turned toward the foot when the shoe is worn and integrated with the outer layer;

an adsorption layer with an adsorption material including activated carbon that adsorbs contaminants is arranged between said outer layer and said inner layer;

wherein said adsorption layer is constructed and arranged in a discontinuous form and is constructed and arranged as an adsorption flat filter; and wherein said activated carbon is in the form of discrete activated carbon particles in granular or spherical form;

wherein said outer layer includes the addition of a flame-inhibiting material which is selected from the group consisting of a coating and an impregnation, said flame-inhibiting material being made on the basis of (i) phosphoric acid compounds; (ii) metal salts; (iii) fluorinated polymers, and mixtures of two or more of the same compounds; and a spacer layer is additionally arranged between said inner layer and said adsorption layer, wherein said spacer layer includes a material selected from the group consisting of a non-woven material, a foam material, and a textile sheet material.

5. A flame-resistant shoe according to claim 4, wherein the flame-resistant shoe is constructed and arranged as a boot for a firefighter.

6. A flame-resistant shoe according to claim 4, wherein said inner layer is constructed and arranged as the flame-resistant shoe inner liner.

7. A flame-resistant shoe according to claim 4, wherein the phosphoric acid compounds are phosphoric acid esters.

8. A flame-resistant shoe according to claim 4, wherein the metal salts are antimony or aluminum salts.

9. A flame-resistant shoe according to claim 4, wherein said outer layer is made from a substantially non-flammable material.

10. A flame-resistant shoe according to claim 9, wherein said outer layer is made of leather.

11. A flame-resistant shoe according to claim 4, wherein the flame-resistant shoe further includes at least one membrane.

12. A flame-resistant shoe according to claim 11, wherein the membrane is arranged between the outer layer and the adsorption layer.

13. A flame-resistant shoe according to claim 11, wherein the membrane is arranged between the inner layer and the adsorption layer.

14. A flame-resistant shoe according to claim 11, wherein the membrane is water-impermeable and air-impermeable.

15. A flame-resistant shoe according to claim 11, wherein the membrane is breathable.

16. A flame-resistant shoe according to claim 11, wherein the membrane consists of a synthetic material, wherein the synthetic material is selected from the group consisting of polyurethanes, polyether amides, polyester amides, polyether esters, polytetrafluoroethylenes and polymers based on cellulose.

17. A flame-resistant shoe according to claim 4, wherein said fire-resistant shoe includes a substantially non-flammable sole including water-impermeable and air-impermeable material.

18. A flame-resistant shoe according to claim 4, wherein said adsorption layer is affixed to a support, and the adsorption material is constructed and arranged on a side of said support that is turned away from the foot when the shoe is worn.

19. A flame-resistant shoe according to claim 4, wherein the activated carbon has an internal surface area (BET) in the range of 800 to 1500 $m^2/g$.

20. The flame-resistant shoe of claim 19 which further includes at least one water-impermeable and air-impermeable membrane.

21. The flame-resistant shoe of claim 20 which further includes a substantially non-flammable sole including water-impermeable and air-impermeable material.

22. A flame-resistant shoe according to claim 4, wherein the activated carbon particles are impregnated with at least one catalyst, where enzymes or metal ions selected from the group consisting of copper, silver, cadmium, platinum, palladium, zinc and/or mercury ions are used as catalyst and where the amount of catalyst is 0.05 to 12 wt %, with respect to the weight of the adsorption layer.

23. A flame-resistant shoe according to claim 4, wherein the individual layers are bonded together.

24. A flame-resistant shoe according to claim 4, wherein the individual layers form a composite.

25. The flame-resistant shoe of claim 4 which further includes at least one water-impermeable and air-impermeable membrane.

26. The flame-resistant shoe of claim 25 which further includes a substantially non-flammable sole including water-impermeable and air-impermeable material.

27. The flame-resistant shoe of claim 4 which further includes a substantially non-flammable sole including water-impermeable and air-impermeable material.

* * * * *